US010913586B2

(12) United States Patent
Jian

(10) Patent No.: US 10,913,586 B2
(45) Date of Patent: Feb. 9, 2021

(54) CONTAINER COVER AND CONTAINER

(71) Applicant: Shanghai Hongyan Returnable Transit Packagings Co., Ltd., Shanghai (CN)

(72) Inventor: Yuanli Jian, Shanghai (CN)

(73) Assignee: Shanghai Hongyan Returnable Transit Packagings Co., Ltd., Shanghai (CN)

( * ) Notice: Subject to any disclaimer, the term of this patent is extended or adjusted under 35 U.S.C. 154(b) by 21 days.

(21) Appl. No.: 16/321,009

(22) PCT Filed: Jul. 24, 2017

(86) PCT No.: PCT/CN2017/094138
§ 371 (c)(1),
(2) Date: Jan. 25, 2019

(87) PCT Pub. No.: WO2018/019209
PCT Pub. Date: Feb. 1, 2018

(65) Prior Publication Data

US 2019/0177060 A1 Jun. 13, 2019

(30) Foreign Application Priority Data

Jul. 25, 2016 (CN) ..... 2016 1 0590728

(51) Int. Cl.
*B65D 55/02* (2006.01)
*B65D 19/04* (2006.01)
(Continued)

(52) U.S. Cl.
CPC ..... *B65D 55/02* (2013.01); *B65D 19/04* (2013.01); *B65D 19/18* (2013.01);
(Continued)

(58) Field of Classification Search
CPC ..... B65D 21/0223; B65D 21/0217; B65D 2519/00706; B65D 2519/00711; B65D 55/14
See application file for complete search history.

(56) References Cited

U.S. PATENT DOCUMENTS 7,907,394 B2 * 3/2011 Richardson ..... G06F 1/1613 312/223.1

FOREIGN PATENT DOCUMENTS

CN 2740539 Y 11/2005
CN 2880700 Y 3/2007
(Continued)

*Primary Examiner* — James N Smalley
*Assistant Examiner* — Don M Anderson
(74) *Attorney, Agent, or Firm* — Kilpatrick Townsend & Stockton LLP

(57) ABSTRACT

Disclosed is a container cover (1) for use in cooperation with a container (100), wherein the container (100) comprises a bottom (4) and side plates (2), the container cover (1) has four corners (10), each of which is provided with a position limiting protrusion (11), and the position limiting protrusion (11) protrudes from an upper surface of the container cover (1) integrally; and at least one position limiting protrusion (11) is provided with a locking means (3), which is used to lock the container cover (1) and the container (100). The structure provides the locking means of the cover and a container body on a stacking limiting structure without occupying container space therebelow, and meanwhile, simple operation and good structural strength are achieved.

13 Claims, 9 Drawing Sheets

(51) Int. Cl.

| | |
|---|---|
| ***B65D 43/02*** | (2006.01) |
| ***B65D 19/18*** | (2006.01) |
| ***B65D 21/02*** | (2006.01) |

(52) U.S. Cl.

CPC ..... *B65D 21/0223* (2013.01); *B65D 43/0202* (2013.01); *B65D 2519/009* (2013.01); *B65D 2519/00333* (2013.01); *B65D 2519/00582* (2013.01); *B65D 2519/00621* (2013.01); *B65D 2519/00646* (2013.01); *B65D 2519/00666* (2013.01); *B65D 2519/00711* (2013.01); *B65D 2519/00975* (2013.01); *B65D 2543/00194* (2013.01); *B65D 2543/00537* (2013.01)

(56) References Cited

FOREIGN PATENT DOCUMENTS

| | | | |
|---|---|---|---|
| CN | 2928707 | Y | 8/2007 |
| CN | 101342962 | A | 1/2009 |
| CN | 201842356 | U | 5/2011 |
| CN | 104590787 | A | 5/2015 |
| CN | 104870326 | A | 8/2015 |
| CN | 104944012 | A | 9/2015 |
| CN | 104960813 | A | 10/2015 |
| CN | 204751106 | U | 11/2015 |
| CN | 205240371 | U | 5/2016 |
| CN | 106219054 | A | 12/2016 |
| CN | 104590787 | A | 6/2017 |
| DE | 29804061 | U1 | 6/1998 |
| EP | 1486426 | A2 | 12/2004 |
| FR | 2339041 | A1 | 8/1977 |
| JP | H03-100171 | U | 10/1991 |
| JP | 2015151136 | A | 8/2015 |
| WO | 2015104002 | A1 | 7/2015 |
| WO | 2016112862 | A1 | 7/2016 |

* cited by examiner

CONTAINER COVER AND CONTAINER

CROSS-REFERENCE TO RELATED APPLICATIONS

This application is a national stage of International Application No. PCT/CN2017/094138, filed on Jul. 24, 2017, which claims priority to the Chinese Application No. 201610590728.3, filed on Jul. 25, 2016. Both referenced applications are hereby incorporated by reference in their entireties.

TECHNICAL FIELD

This invention relates to logistics transportation field, and in particular relates to a container cover and a container.

BACKGROUND OF THE INVENTION

Packing, transporting and storing goods with large container made of composite material is a common method in some industrial production. These containers generally have side plates and a bottom of plastic, with metal tubes therein for strengthening. When containing liquid, a lining bag is deployed in the container, then liquid is filled in the lining bag. After the filling of liquid is finished, a cover will be placed on the container to protect the contents in the container from being polluted by raining, dust and the like. Further, regardless whether the container is foldable or not, the cover connected with a container body can always provide enough support to the whole strength. When the container body is filled with liquid, with shaking, rapid acceleration and deceleration during transportation, the liquid in the container body fluctuates dramatically. Then, the cover can effectively reduce the fluctuation of the liquid, prevent the bag from breaking due to large stress, so as to ensure the safety of the liquid. The function of the cover of a large container further lies in that when two containers are stacked one on the other, the cover can limit the movement of upper container in horizontal directions, so that the upper container will not topple.

FIG. 10 is perspective view of a traditional cover in the prior art. As shown in FIG. 10, the cover has protruding edge around the perimeter thereof for hooping the opening of the container. Meanwhile, the cover has four manual operated cover locks with latches for connecting the cover to the container body, so that the cover can resist the shocking of the internal liquid. When two containers need to be stacked, foots on the bottom of the container and the stacking limiting member raised on the cover abut with each other, ensuring the stability of the upper container body relative to the lower container body. The cover of such a structure meets the function demand of the container to some extent. However, the manual operated lock is not convenient for operation. Further, the raising of the stacking limiting member and the depressing of the mounting seat of the cover lock affect the stacking height of the container body or the upper structure of the side plates negatively.

CN 104590787 A discloses a novel cover locking structure, the locking structure with elastic restoration lessens the inconvenient locking of the cover in the above solution and can be operate easily. However, the depressing space is stilled needed on the cover to place the structure.

Further, according to the practice and testing data, the closer the locking structure on the cover to the top corners of the container body, the more stable of the locking, because the deformation of the top corners of the container is smaller than other portions, rendering the locking effect of the locking structure more stable. Meanwhile, in view of the cover structure, when the locking structure is close to the four top corners, the cover has the highest strength for resisting the shocking from liquid in the container body. However, the containers need to be stacked, the foots on the upper container are placed on the lower container, so that the portions adjacent to top corners of the cover (i.e. the parts under four foots on top of the container) become the main bearing portions. All the prior solutions avoid placing the locking structure in these portions. Further, in order to remedy the possible insufficient strength due to the locking structures are not at the corners, some products in commercial have locking structures at four edges of the cover, so that the operation of the cover is not convenient.

SUMMARY OF THE INVENTION

It is an object of the present invention to provide a container cover and container thereof to solve the above problems in the prior art.

In order to solve the above problems, according to an aspect of the present invention, a container cover is provided, the container includes a bottom and side plates, the container cover has four corners, each of which is provided with a position limiting protrusion which integrally protrude upward from the upper surface of the container cover, wherein at least one of the position limiting protrusions is provided with a locking means, which is used to lock the container cover and the container.

In one embodiment, the container is a large scale container.

In one embodiment, a body portion of the position limiting protrusion is located at the inner side of the side plate.

In one embodiment, two of the position limiting protrusions are provided with a locking means respectively, and the two position limiting protrusions provided with the locking means are located above the same side plate.

In one embodiment, each of the position limiting protrusion is provided with the locking means.

In one embodiment, the locking means includes a driving member and a locking member, an upper surface of the position limiting protrusion is provided with a pocket in which the driving member is movably mounted, wherein the locking member is connected with the driving member and able to enter the side plate of the container, so as to lock the container cover and the container with each other.

In one embodiment, the position limiting protrusion includes a body portion and an extending portion, the body portion is located at the inner side of the side plate, and the extending portion extends from the body portion toward the outer side of the container, wherein the locking means includes a driving member and a locking member, an upper surface of the body portion is provided with a pocket for receiving the driving member, an end face of the extending portion is provided with a latching hole for receiving the locking member, and the latching hole is communicated with the pocket.

In one embodiment, the extending portion is located above the side plate.

In one embodiment, the extending portions of each of the position limiting protrusions extend toward the same or opposite directions.

Preferably, the locking member includes a latch and a tongue, the container cover is provided with a protruding edge around the perimeter thereof, which is provided with a tongue passing hole, and the side plate is provided with a tongue accommodating hole, wherein the tongue is able to pass through the tongue passing hole and enter the tongue accommodating hole so that the container cover and the side plate can be locked with each other.

In one embodiment, the latch and the tongue are formed integrally.

In one embodiment, the latch includes a first part and a second part which form a "L"-shaped structure, wherein the first part extends into the latching hole, and the second part is provided with a tongue.

In one embodiment, between the latching hole and the tongue passing hole is provided a groove in which the second part of the latch is located.

In one embodiment, two of the position limiting protrusions are provided with the locking means, and the two position limiting protrusions provided with the locking means are located on a same side, wherein extending portions of the two position limiting protrusions extend in the same direction.

In one embodiment, the driving member includes a protruding portion and a base, the protruding portion protrudes upward from the base integrally, and a restoring elastic strip is provided on one side of the protruding portion.

In one embodiment, a driving pin is provided on the driving member, and protrudes upward from the base integrally, a driving hole is provided on the latch of the locking member, the driving member and the locking member are connected through inserting the driving pin into the driving hole.

In one embodiment, cavities are provided in the bottom for cooperating with the position limiting protrusions, when a multiple of containers are stacked together, the position limiting protrusions on the container cover of the lower container are received in the cavities in the bottom of the upper container, so that the upper and lower containers are positioned relative to each other.

In one embodiment, there is a gap between the cavity and the position limiting protrusion so as to facilitate the stacking operation of the upper container.

In one embodiment, the position limiting protrusion includes a body portion and an extending portion, the body portion is located at the inner side of the side plate, and the extending portion extends from the body portion toward the outer side of the container, wherein the upper surface of the body portion is provided with a pocket, the locking means includes a driving member and a locking member, and the driving member is movably mounted in the pocket, the container cover is provided with a protruding edge around the perimeter thereof, the locking member includes a latch and a tongue, an end face of the extending portion is provided with a latching hole for receiving the locking member, the protruding edge is provided with a tongue passing hole, and the side plate of the container is provided with a tongue accommodating hole, wherein the latch passes through the latching hole and enter the pocket so as to be connected with the driving member, the tongue passes the tongue passing hole and enters the tongue accommodating hole;

the tongue can be driven to enter or exit from the tongue accommodating hole through driving the driving member, so as to lock or unlock the container cover and the container.

According to another aspect of the present invention, a container is provided, including a bottom, side plates and the container cover as defined above.

The invention lists the success and deficiency of the cover structure of the large container, cleverly places the locking structure of the cover and the container body in the stacking limiting structure, without occupying container space therebelow, and meanwhile, simple operation and good structural strength are achieved.

DETAILED DESCRIPTION OF THE EMBODIMENTS

The preferred embodiments of the present invention will be described in detail below with reference to the accompanying drawings, so that the purposes, features and advantages of the present invention can be more clearly understood. It should be understood that the embodiments shown in the accompanying drawings are not intended to limit the scope of the present invention, and is only used for illustrating the essential spirit of the technical solution of the present invention.

The container cover according to this invention is used with a container, which includes a bottom and side plates. The container cover has four corners, each of which is provided a position limiting protrusion protruding from the upper surface of the container cover, wherein at least one position limiting protrusion is provided with a locking means thereon for locking the container cover to the container.

In the following, the specific embodiments of the container cover according to this invention will be described with reference to drawings.

Herein, the container generally is the large composite bulk container which can be a foldable container whose side plates can be folded relative to the bottom or an integral container body whose side plates formed with the bottom integrally. The following takes an integral container body as an example.

Figure 1:
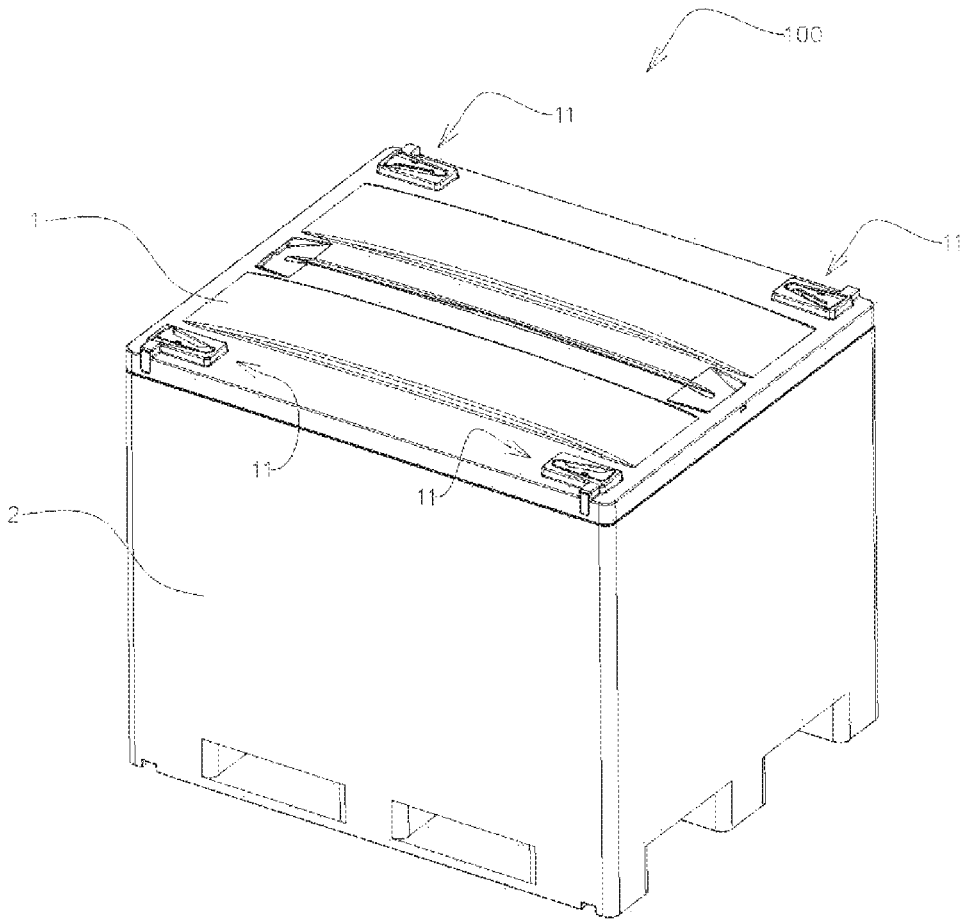
FIG. 1 is the perspective view of the container according to the present invention.
Figure 2:
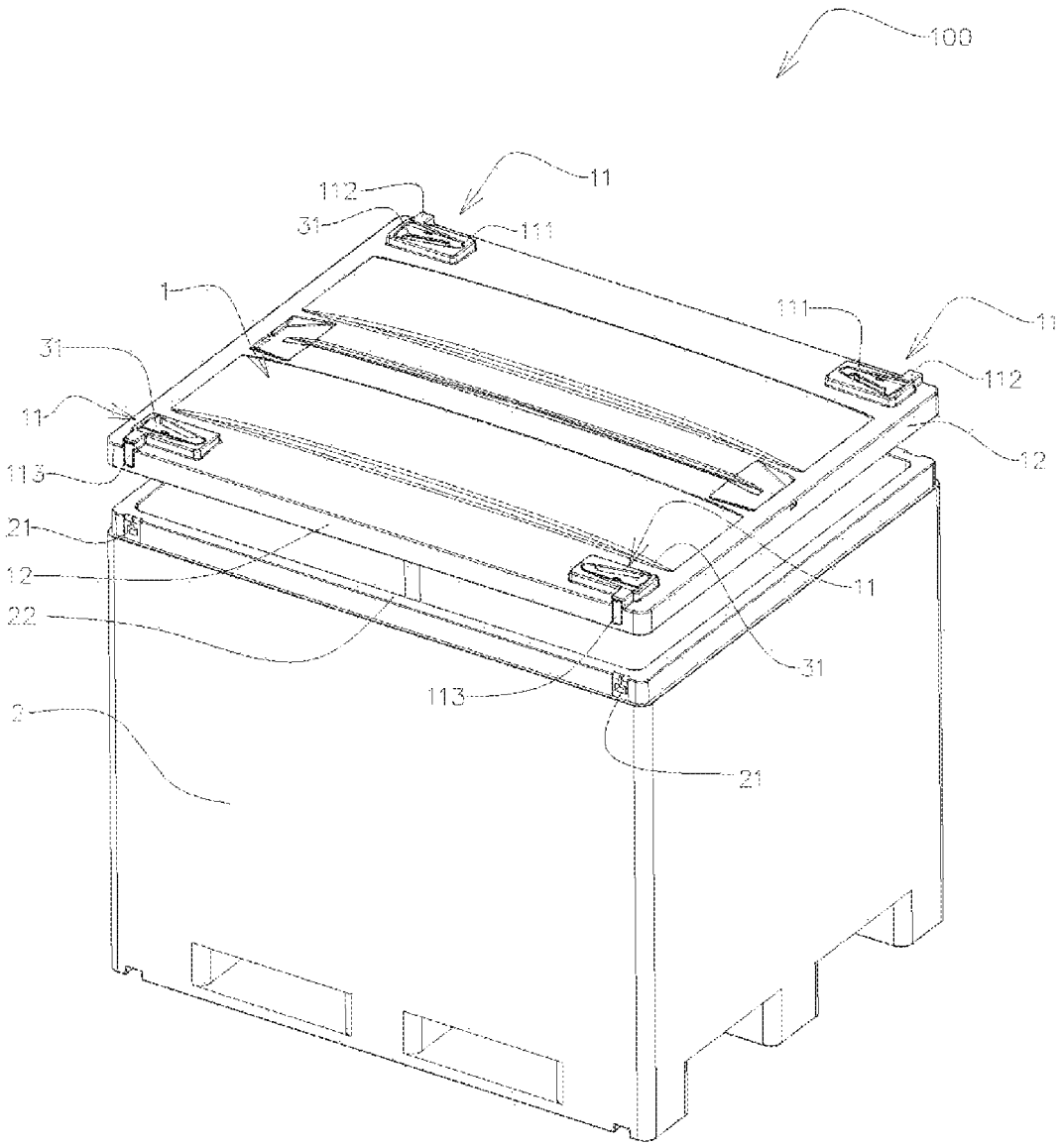
FIG. 2 is the perspective explosive view of the container according to the present invention.
Figure 3:
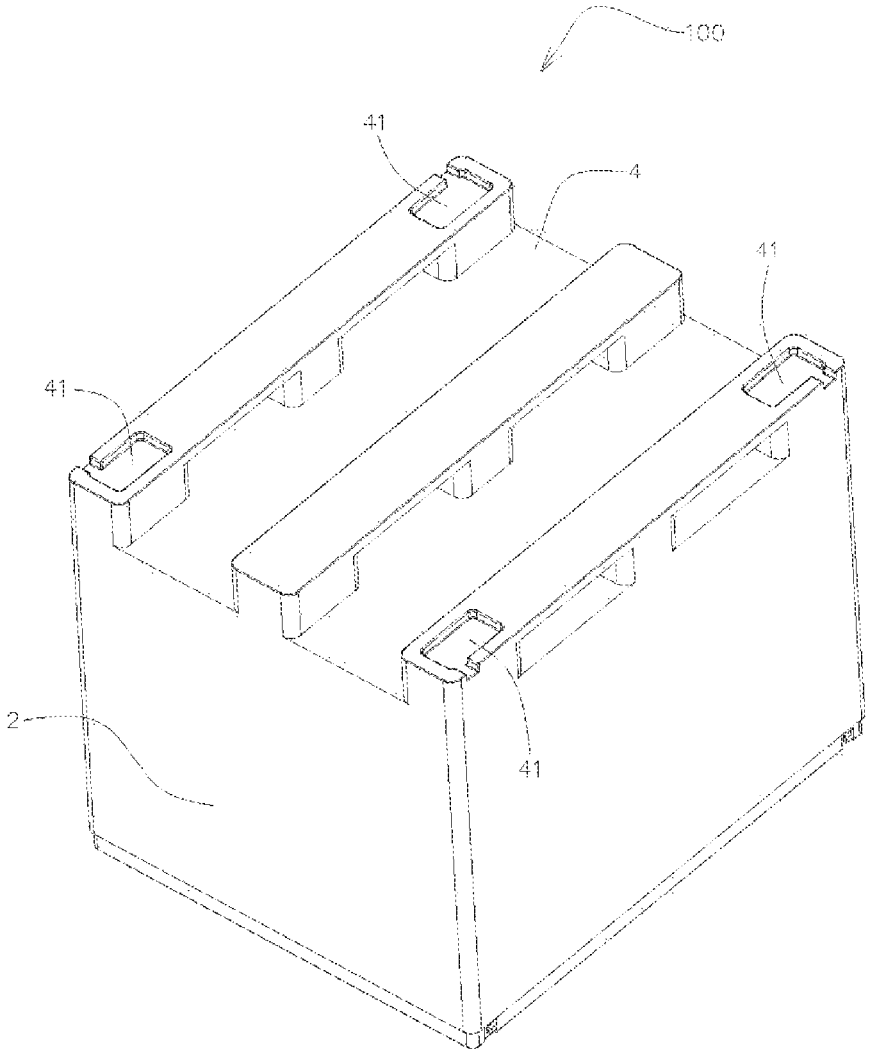
FIG. 3 is another perspective view of the container according to the present invention, showing the bottom of the container.

FIG. 1 is the perspective view of the container according to the present invention, FIG. 2 is the perspective explosive view of the container according to the present invention, and FIG. 3 is another perspective view of the container of the present invention, showing the bottom of the container. As shown in FIGS. 1-3, the container 100 of the present invention includes a container cover 1 (referred to cover 1 hereinafter) and a container body (referred to body hereinafter). The cover 1 is detachably placed on the body. The body includes side plates 2 and a bottom 4, and the side plates 2 are provided on the bottom 4. In this embodiment, an integral container body is taken as an example, thus the side plates 2 and the bottom 4 are formed integrally. However, those skilled in the art can understand, the container 100 may also be a foldable container, that is the side plate 2 can be folded relative to the bottom 4. In this case, the bottom 4 can be a base, the structure thereof refers to Chinese patent CN104944012A.

Figure 4:
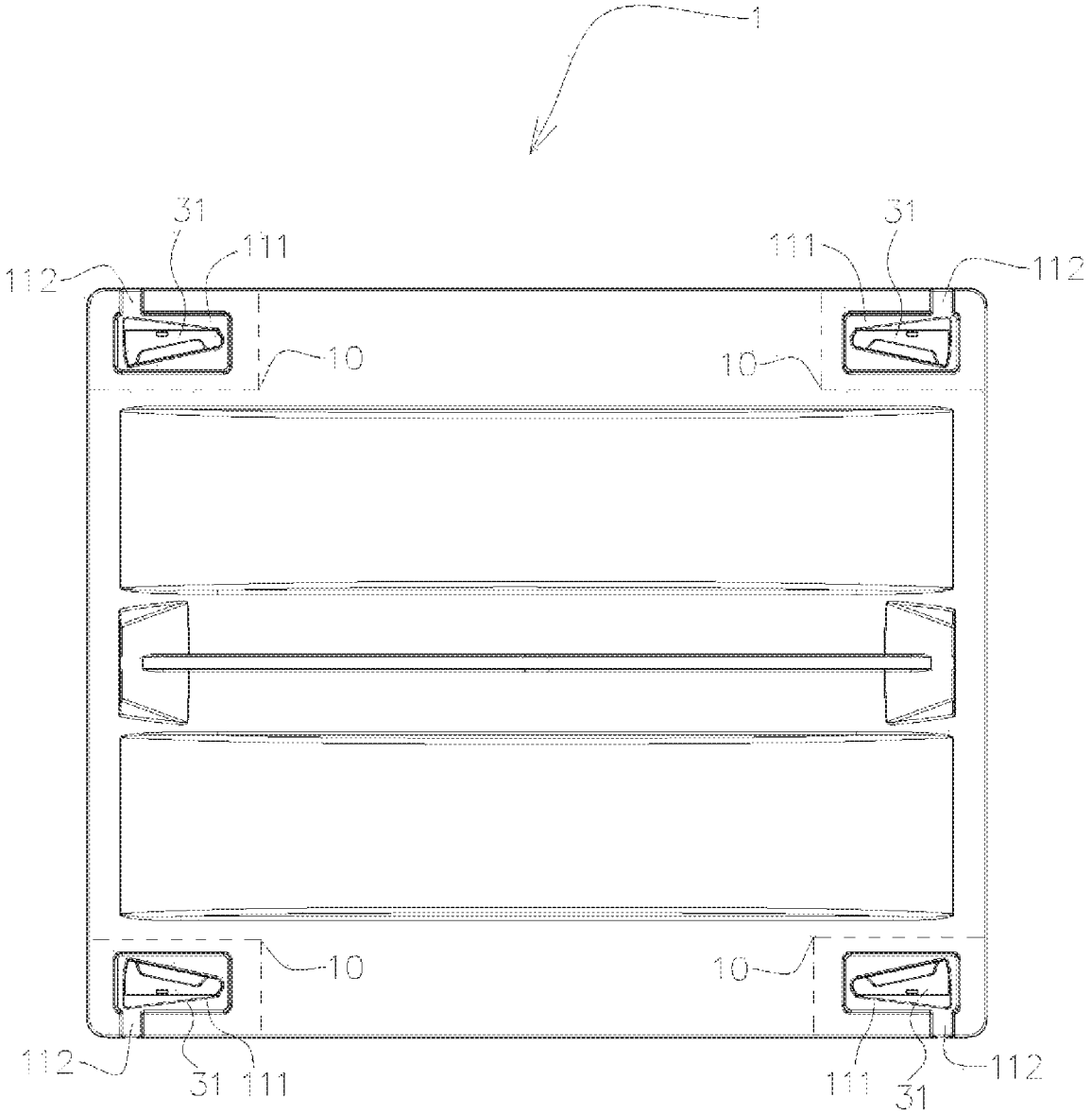
FIG. 4 is the top view of the container cover according to the present invention.

FIG. 4 is the top view of the container cover 1. As shown in FIGS. 1-4, four corners 10 of the cover 1 (the area enclosed by the dashed lines in FIG. 2) are provided with position limiting protrusions 11 respectively, which integrally protrude from the upper surface of the cover 1. In this invention, the corner 10 is 150-300 mm in length, and is 100-200 mm in width.

The position limiting protrusion 11 includes a body portion 111 and an extending portion 112. The body portion 111 is located at the inner side of the side plate 2, that is, the body portion of the position limiting protrusion 11 do not locate right above the thickness 22 of the side plates of the container body. The extending portion 112 extends toward the outside of the container from the body portion 111. From the explosive view of FIG. 2, it can be seen that, since the side plate 2 of the container body has a certain of thickness 22, when an upper container is stacked thereon, the area of the cover contacting the thickness 22 of the side plate is the main part which transmitting and bearing the load.

In a preferable embodiment, the body portion 111 is provided parallel to the two edges of the cover on the side plate at the corner, and the extending portion 112 extending outwardly perpendicular to the body portion 111. The extending portion 112 spans the thickness 22 of the side plate 2, that is, the extending portion 112 is located above the side plate 2.

In one embodiment, the body portion 111 is parallelepiped in shape and has four sides which parallel to four side plates 2 of the container respectively. The distance between the outside surface of the side plate closest to the position limiting protrusion of the container and the side adjacent to the same side plate of the position limiting protrusion is no less than ⅔ of the thickness of the side plate.

Figure 5:
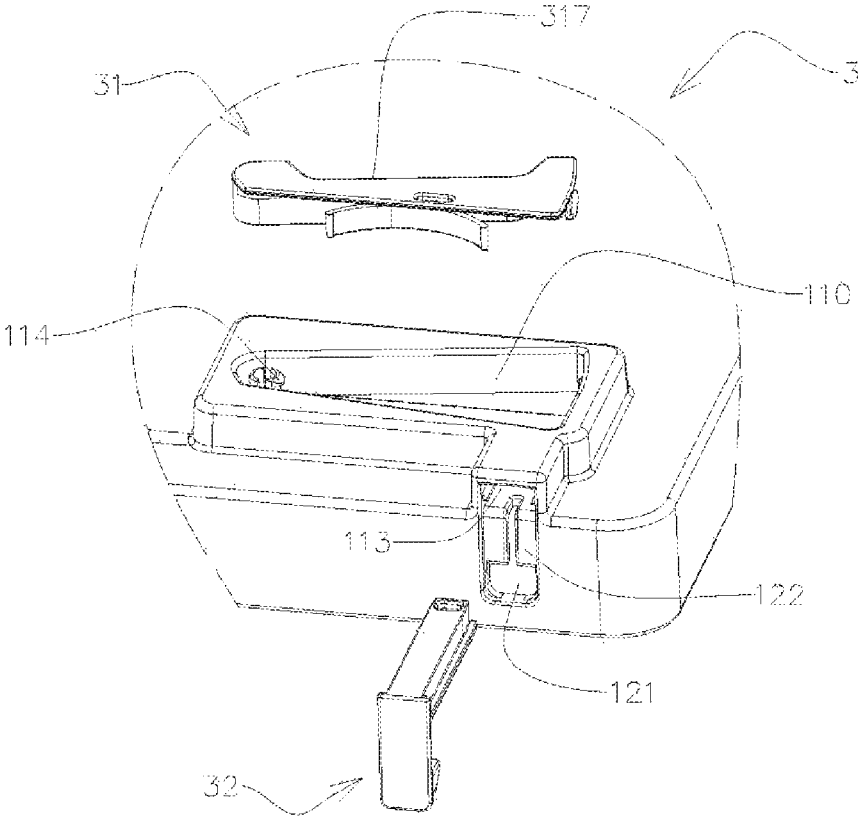
FIG. 5 is the perspective explosive view of the locking means of the container cover according to the present invention.
Figure 6:
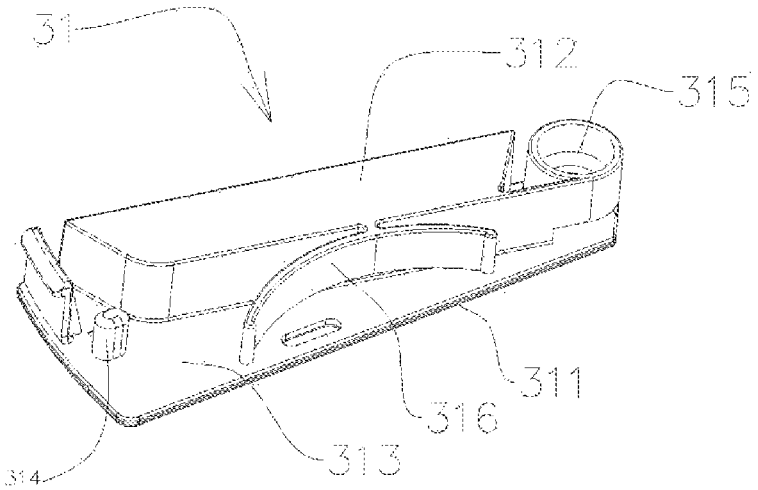
FIG. 6 is the perspective view of the driving member of the locking means according to the present invention.

FIG. 4 is the top view of the container cover of this invention, FIG. 5 is the perspective explosive view of the locking means of the container cover according to this invention, FIG. 6 is the perspective view of driving member of the locking means according to this invention. As shown in FIGS. 1-6, a locking means 3 is provided on the position limiting protrusion 11. The locking means 3 includes a driving member 31 and a locking member 32. The position limiting protrusion 11 is provided with a pocket 110 for accommodating a driving member 31 which can be movably mounted in the pocket 110. The locking member 32 includes a latch 321 and a tongue 322. The latch 321 includes a first part 3211 and a second part 3212 which form a "L"-shaped latch 321. The tongue 322 is provided on the second part 3212. In one embodiment, the latch 321 and the tongue 322 are formed integrally. A driving hole 3213 is provided on the upper surface of the first part 3211 of the latch 321, and is used to engage with the driving pin 314 of the driving member 31 so as to connect the driving member 31 to the locking member 32, as described later.

As shown in FIG. 2, a protruding edge 12 extends downwardly from the perimeter of the cover 1, and surrounds the body portion of the cover. When the cover 1 is engaged on the container body, the protruding edge 12 surrounds the four side plates of the container body. The latching hole 113 is provided on the end face of the extending portion 112 facing away the body portion 111 of the position limiting protrusion 11. The latching hole 113 passes through the extending portion 112 and communicates with the pocket 110. A tongue passing hole 121 is provided on the protruding edge 12 of the cover 1 under the latching hole 113, and penetrates through the protruding edge 12 of the cover 1. The tongue passing hole 121 is substantially parallel to the latching hole 113. A tongue accommodating hole 21 is provided on the side plate at the position corresponding to the tongue passing hole 121. When the cover 1 is mounted to the container body, the tongue 322 of the locking member 32 can pass through the tongue passing hole 121 and enter the tongue accommodating hole 21. The tongue passing hole 121 and the latching hole 113 are communicated with each other via the groove 122. When mounting the latch 321, the first part 3211 is accommodated in the latching hole 113, and the second part 3212 is accommodated in the groove 122.

As shown in FIG. 6, the driving member 31 includes a base 311 and a protruding portion 312. The driving member 31 is generally triangle in cross section, and has a wide end and a narrow end. The protruding portion 312 protrudes upward (relative to the positioning in FIG. 6) from the base 311, the cross section area of the protruding portion 312 is less than upper surface area of the base 311, leaving a clear region 313 on the base 311. A driving pin 314 is provided on the clear region 313 near the wide end and is used to engage with the driving hole 3213 on the locking member 32. That is, the driving pin 314 can be inserted into the driving hole 3213, so as to connect the driving member 31 to the locking member 32, so that the driving member 31 can drive the locking member 32. A connecting hole 315 is provided in the protruding portion 312 near the narrow end, for engaging with a connector so as to mount the driving member in the pocket 110, as described in detail later. A restoring elastic strip 316 is provided on the side facing outside of the container when mounted of the protruding portion 312, for resetting the driving member when unlocking by operating the driving member. Correspondingly, a holding notch 317 is provided on the side of the protruding portion 312 opposite to the restoring elastic strip 316, for facilitating to be hold by hand when operating the driving member 31.

As shown in FIG. 4, likewise, the pocket 110 is generally triangle in cross section and has a wide end and a narrow end. A positioning member 114 is provided on the bottom of the pocket 110 near the narrow end. In this embodiment, the positioning member 114 is a protrusion which protrudes integrally from the bottom surface of the pocket 110. When mounting the driving member 31, the connecting hole 315 in the driving member 31 is rotatably engaged with the positioning member 114, that is, the positioning member 114 is rotatably inserted into the connecting hole 315, so as to rotatably mount the driving member 31 in the pocket 110.

Figure 8:
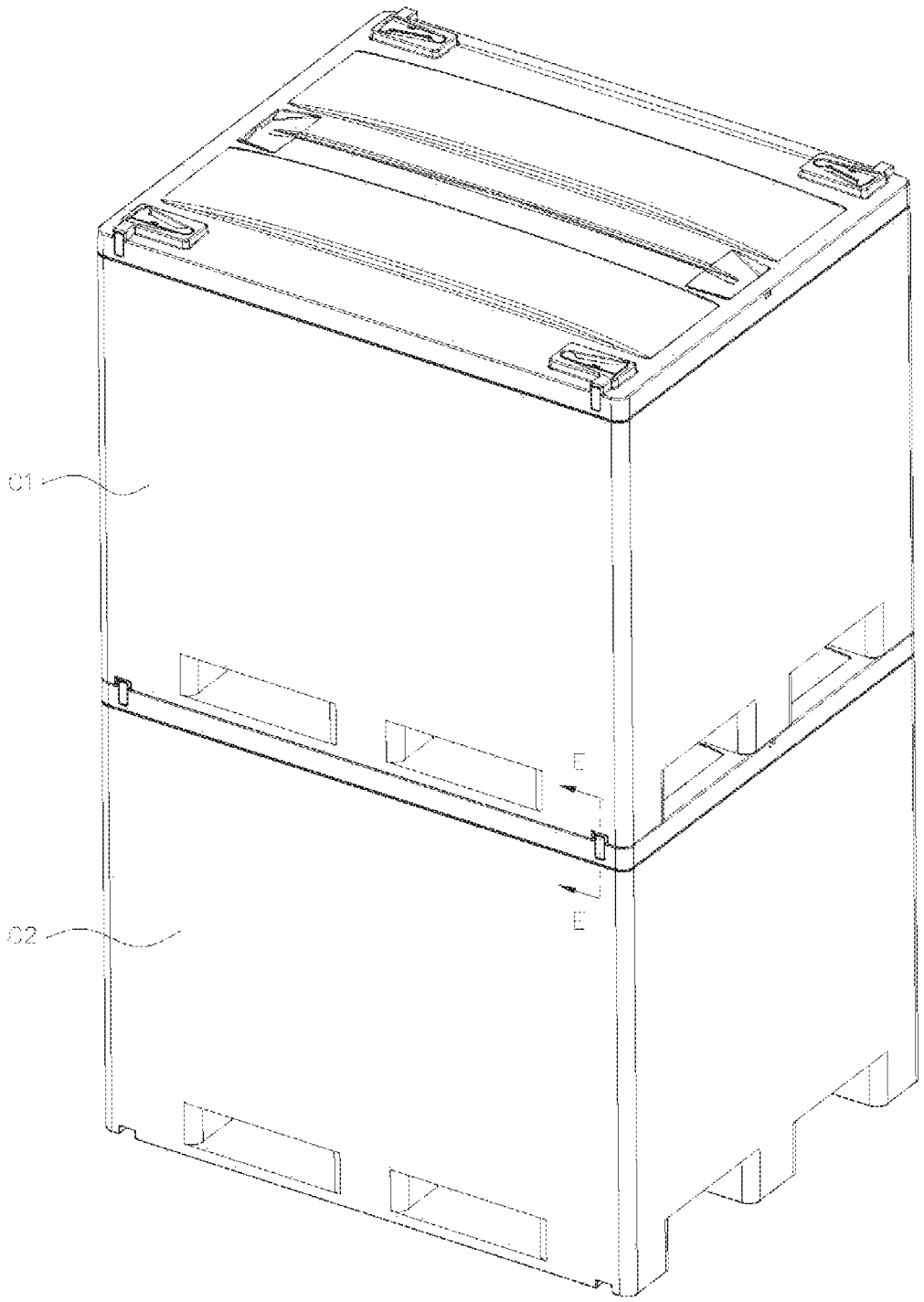
FIG. 8 is the perspective view of two containers according to the present invention stacked together.
Figure 9:
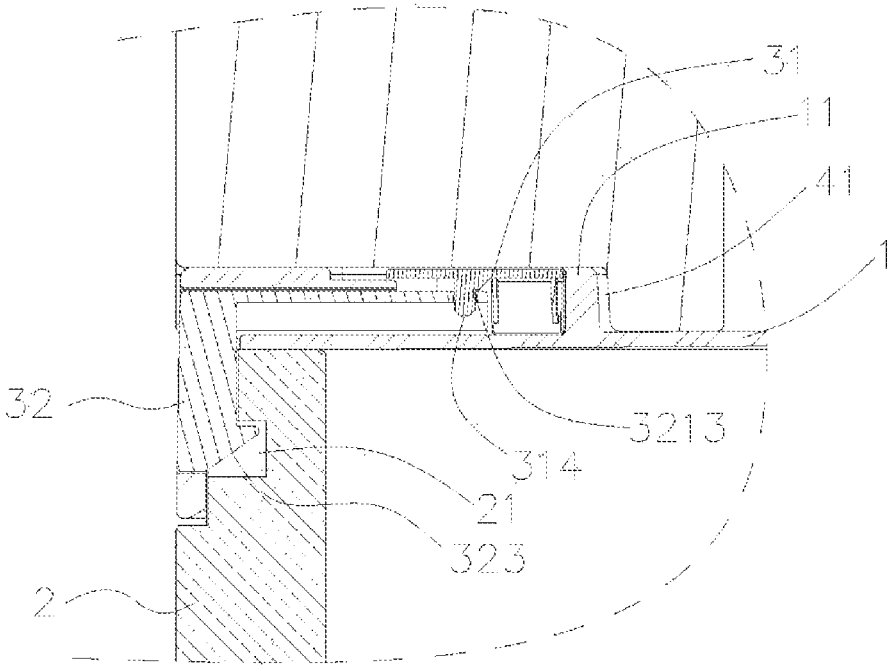
FIG. 9 is the partial section view of the container according to the present invention.
Figure 10:
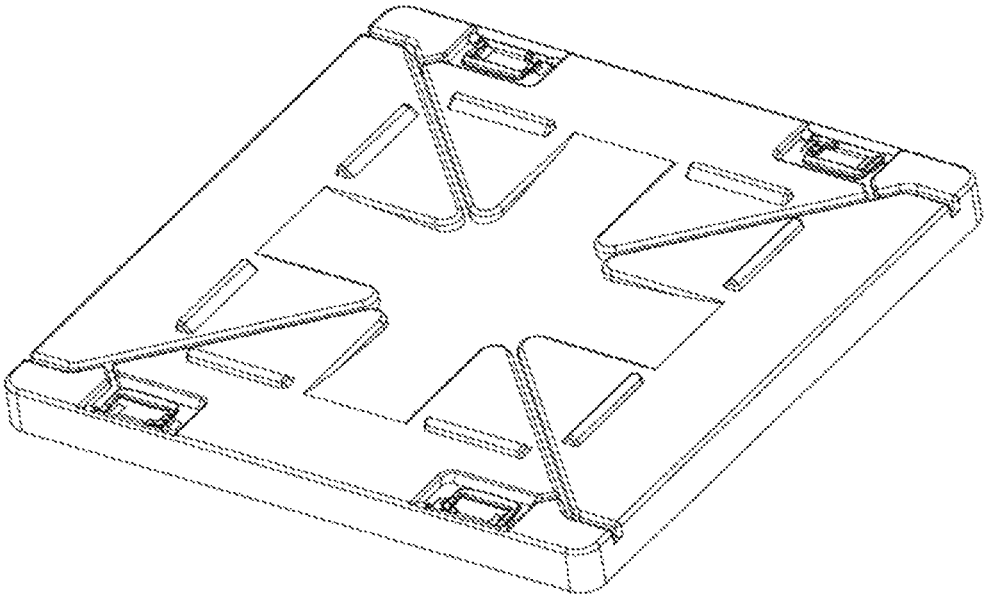
(Prior Art) Fig. 10
FIG. 10 is the perspective view of a prior container cover.

FIG. 8 is a perspective view of two containers according to the present invention stacked together; FIG. 9 is a partial section view of the container according to the present invention. As shown in FIGS. 3 and 8-9, the bottom 4 is provided with a cavity 41, when two containers C1 and C2 (both containers C1 and C2 are the containers 100 according to the present invention) stacked together, the cavity 41 in the bottom of the upper container C1 engages with the position limiting protrusion 11 on the lower container C2, so as to position containers C1 and C2 relative to each other.

As shown in FIG. 9, when mounting, the driving member 31 is in the pocket 110, the positioning member 114 in the pocket 110 is accommodated in the connecting hole 315 of the driving member 31, and the driving pin 314 of the driving member 31 is inserted into the driving hole 3213 of the locking member 32, so as to connect the driving member 31 to the cover 1 and connect the locking member 32 to the driving member 31, wherein the first part 3211 of the latch 321 of the locking member 32 is accommodated in the latching hole 113, the second part 3212 of the latch 321 of the locking member 32 is located in the groove 122 of the cover 1; while the tongue 322 passes through the tongue passing hole 121 and enters the tongue accommodating hole 21 in the side plate 2, so as to lock the cover 1 with the container side plate.

As shown in FIGS. 8-9, when the upper and lower containers C1 and C2 (both containers C1 and C2 are the containers 100 according to the present invention) are stacked together, the position limiting protrusion 11 is totally received in the cavity 41. Since the locking means is located in the position limiting protrusion 11, the locking means 3 is also received in the cavity 41. In one embodiment, there is a gap between the position limiting protrusion 11 and the cavity 41 to facilitate the stacking operation of the upper container C1.

Figure 7:
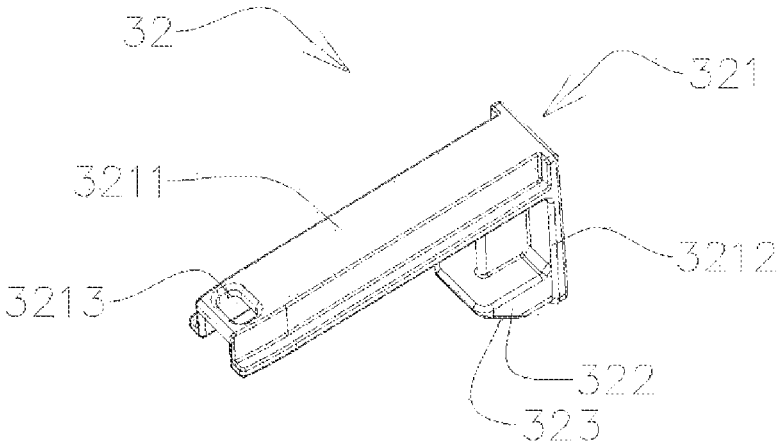
FIG. 7 is the perspective view of the locking member of the locking means according to the present invention.

As shown in FIG. 7, the cavities 41 provided in the bottom of the container 100 correspond to the position limiting protrusions 11, so that when two containers are stacked together as shown in FIGS. 8 and 9, the cavities 41 fit over the position limiting protrusions 11, leaving a gap therebetween to facilitate the stacking operation of the upper container. Meanwhile, the driving pin 314 of driving member 31 in the position limiting protrusion 11 on the cover 1 engages with the driving hole 3213 in the locking member 32 to lock or unlock the tongue. The tongue 322 can be inserted in the tongue accommodating hole 21 in the side plate 2 of the container body to lock the cover 1 and the side plate 2 together. Since both the driving member 31 in the cover and the first part 3211 of the latch 321 of the locking member are provided in the space formed by the position limiting protrusion 11, the inner side of the cover can be kept smooth without damaging the bearing surface structure above the container 100.

The preferred solution for the locking structure of the cover 1 according to this invention is that: the tongue 322 is perpendicularly inserted into the tongue accommodating hole 21 from the surface of the side plate 2 of the container, and a guiding slope 323 is provided at the lower part of the tongue 322, with a restoring elastic strip 316 provided on the driving member 31. The guiding slope of the tongue 322 can ensure that a multiple layers of containers will not being damaged during stacking even if the cover 1 is not placed in position. The restoring elastic strip 316 maintains the latch 321 of the locking member 32 always in the locking condition. Further, since the locking means is provided on two opposite sides of the container, when the two locking means on one side are unlocked, by lifting the cover and pushing it toward the other side, the unlocking of the cover can be easily achieved.

Although in the above embodiments, the condition where each of the four position limiting protrusions 11 is provided with a locking means is described, according to another embodiment of this invention, the locking means can only be provided on two of the position limiting protrusions 11, and the two position limiting protrusions 11 provided with a locking means are located at the same side of the container, that is, the tongue accommodating holes for receiving the tongues of the two locking means are located in the same side plate. At this time, hanging holes are also provided on side of the side plate opposite to that providing with tongue accommodating hole, meanwhile, hanging hooks are correspondingly provided on the opposite side of the container cover. By means of the cooperation between the hanging hooks and the hanging holes on the opposite sides and the cooperation between the tongues and tongue accommodating holes of two locking means, the container cover can be locked to the side plate of the container. In this embodiment, when unlocking, what required is only operating the driving member at the side provided with the locking means, and exiting the tongue from the tongue accommodating hole, and pushing the container cover toward the side without locking means, so that the hanging hooks are exited from the hanging holes, then the cover is unlocked.

Although the embodiment where two position limiting protrusions are provided with a locking means or all of the position limiting protrusions are provided with a locking means is described, it should be understood that alternatively only one position limiting protrusion is provided with a locking means. In such a case, the problem in the prior art can also be solved to some extent. However, the embodiment where two or four position limiting protrusions are provided a locking a means is preferred.

The invention lists the success and deficiency of the cover structure of the large container, cleverly places the locking structure of the cover and the container body on the stacking limiting structure, without occupying container space therebelow, and meanwhile, simple operation and good structural strength are achieved.

Preferable embodiments of the invention have been described in detail as above. It should be understood, after reading the above teaching of the invention, various changes or modifications of the invention can be made by those skilled in the art. All of the equivalents fall in the protection scope defined by the attached claims.

What is claimed is:

1. A container cover for use in cooperation with a container, the container includes a bottom and side plates, wherein the container cover has four corners, each of which is provided with a position limiting protrusion which integrally protrude upward from the upper surface of the container cover, wherein at least one of the position limiting protrusions is provided with a locking means, wherein the locking means includes a driving member and a locking member, and an upper surface of the position limiting protrusion is provided with a pocket in which the driving member is movably mounted, wherein the locking member is connected with the driving member and able to enter the side plate of the container, so as to lock the container cover and the container with each other.

2. The container cover according to claim 1, wherein two of the position limiting protrusions are provided with a locking means respectively, and the two position limiting protrusions provided with the locking means are located above the same side plate.

3. The container cover according to claim 1, wherein each of the position limiting protrusion is provided with the locking means.

4. The container cover according to claim 1, wherein the position limiting protrusion includes a body portion and an extending portion, the body portion is located at the inner side of the side plate, and the extending portion extends from the body portion toward the outer side of the container, wherein the body portion is provided with the pocket on the upper surface thereof for receiving the driving member, an end face of the extending portion is provided with a latching hole for receiving the locking member, and the latching hole is communicated with the pocket.

5. The container cover according to claim 4, wherein the locking member includes a latch and a tongue, the container cover is provided with a protruding edge around the perimeter thereof, which is provided with a tongue passing hole, and the side plate is provided with a tongue accommodating hole, wherein the tongue is able to pass through the tongue passing hole and enter the tongue accommodating hole so that the container cover and the side plate are able to be locked with each other.

6. The container cover according to claim 5, wherein the latch includes a first part and a second part which form a "L"-shaped structure, wherein the first part extends into the latching hole, and the second part is provided with a tongue.

7. The container cover according to claim 6, wherein a groove is provided between the latching hole and the tongue passing hole in which the second part of the latch is located.

8. The container cover according to claim 5, wherein two of the position limiting protrusions are provided with the locking means, and the tongue accommodating hole for engaging the locking means on the two position limiting protrusions are located on the same side plate.

9. The container cover according to claim 1, wherein the driving member includes a protruding portion and a base, the protruding portion protrudes upward from the base integrally, and a restoring elastic strip is provided on one side of the protruding portion.

10. The container cover according to claim 9, wherein a driving pin is provided on the driving member, and protrudes upward from the base integrally, a driving hole is provided on the latch of the locking member, the driving member and the locking member are connected through inserting the driving pin into the driving hole.

11. The container cover according to claim 1, wherein cavities are provided in the bottom for cooperating with the position limiting protrusions, when a multiple of containers are stacked together, the position limiting protrusions on the container cover of the lower container are received in the cavities in the bottom of the upper container, so that the upper and lower containers are positioned relative to each other.

12. The container cover according to claim 1, wherein the position limiting protrusion includes a body portion and an extending portion, the body portion is located at the inner side of the side plate, and the extending portion extends from the body portion toward the outer side of the container, wherein the body portion is provided with the pocket in the upper surface thereof, the driving member is movably mounted in the pocket, the container cover is provided with a protruding edge around the perimeter thereof, the locking member includes a latch and a tongue, an end face of the extending portion is provided with a latching hole for receiving the locking member, the protruding edge is provided with a tongue passing hole, and the side plate of the container is provided with a tongue accommodating hole, wherein the latch passes through the latching hole and enter the pocket so as to be connected with the driving member, the tongue passes through the tongue passing hole and enters the tongue accommodating hole;

the tongue is able to be driven to enter or exit from the tongue accommodating hole through driving the driving member, so as to lock or unlock the container cover and the container.

13. A container, comprising:

a container cover for use in cooperation with the container, the container further comprising:

a bottom and side plates, wherein the container cover has four corners, each of which is provided with a position limiting protrusion which integrally protrude upward from the upper surface of the container cover, wherein at least one of the position limiting protrusions is provided with a locking means, wherein the locking means includes a driving member and a locking member, and an upper surface of the position limiting protrusion is provided with a pocket in which the driving member is movably mounted, wherein the locking member is connected with the driving member and able to enter the side plate of the container, to lock the container cover and the container with each other.

* * * * *